US006736394B2

(12) United States Patent
Herrmann et al.

(10) Patent No.: US 6,736,394 B2
(45) Date of Patent: May 18, 2004

(54) PRINTER LATERAL AND DESKEW SHEET REGISTRATION SYSTEM

(75) Inventors: Douglas K. Herrmann, Webster, NY (US); Mark R. Halvonik, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 96 days.

(21) Appl. No.: 10/237,362

(22) Filed: Sep. 6, 2002

(65) Prior Publication Data

US 2004/0046313 A1 Mar. 11, 2004

(51) Int. Cl.[7] ..... B65H 7/02; B65H 9/16
(52) U.S. Cl. ..... 271/249; 271/228
(58) Field of Search ..... 271/249, 228; B65H 7/02, 9/16

(56) References Cited

U.S. PATENT DOCUMENTS 567,356 A * 9/1896 Henn et al. ..... 271/252
5,078,384 A 1/1992 Moore
5,219,159 A * 6/1993 Malachowski et al. ..... 271/228
5,273,274 A * 12/1993 Thomson et al. ..... 271/228
5,278,624 A 1/1994 Kamprath et al.
6,168,153 B1 1/2001 Richards et al.
6,338,483 B1 * 1/2002 Andela et al. ..... 271/227
6,505,831 B2 * 1/2003 Henn et al. ..... 271/227

FOREIGN PATENT DOCUMENTS

JP 58-22238 * 2/1983 ..... B65H/9/00

* cited by examiner

*Primary Examiner*—Donald P. Walsh
*Assistant Examiner*—Kenneth W Bower

(57) ABSTRACT

A sheet lateral registration system, especially for high speed printer print media, which can also provide sheet deskewing as well as lateral sheet registration, having substantially increased lateral translation movement re-centering time for the lateral sheet registration system by utilizing at least two lateral shifting rollers having at least two different radii which provide automatic nip closings and openings in their rotations (relative to opposing idlers), with larger radius circumferential lengths coordinated to the downstream distance of the subsequent sheet acquisition system. Additionally disclosed are coordinated position non-slip sheet feeding nips which may be positioned in the paper path between these dual radius deskewing and lateral registration rollers and the image transfer station of the printer.

15 Claims, 4 Drawing Sheets

PRINTER LATERAL AND DESKEW SHEET REGISTRATION SYSTEM

Cross-reference and incorporation by reference is made to a copending commonly assigned U.S. application Ser. No. 09/916,993, filed Jul. 27, 2001, by Lloyd A. Williams, et al, entitled "Printer Sheet Lateral Registration and Deskewing System."

Disclosed in the embodiments herein is an improved system for sheet lateral position registration (sheet rotational position registration) for print media sheets, especially for an improved "TELER" type of combined lateral sheet registration and deskewing system for a printer.

More specifically, there is disclosed in the embodiments herein an improved integral sheet registration system, especially suited for high speed printers, for providing both sheet deskewing and lateral sheet registration, which provides increased re-centering time, and thus increased acceleration and deceleration latitudes, for the lateral translation movement of the lateral sheet registration system. In the disclosed embodiments this is provided by varying radius sheet feeding rollers providing lateral registration by side-shifting, but with automatic nip openings in their rotations. Additionally disclosed are specially positioned non-slip sheet feeding nips positioned in the paper path between said varying radius rollers and the image transfer station of the printer.

Various sheet registration systems are known in the art, and the present system is not limited to any particular such registration, deskew and/or side-shifting system. Various TELER systems of sheet registration have differential roll pair driving for deskew and sheet side-shifting systems in which the entire structure and mass of the carriage containing the two drive rollers, their opposing nip idlers, and their drive motors connected), is axially side-shifted to side-shift the engaged sheet into lateral registration. These may be referred to as "TELER" systems, of, e.g., U.S. Pat. No. 5,094,442, issued Mar. 10, 1992 to Kamprath et al; U.S. Pat. Nos. 5,794,176 and 5,848,344 to Milillo et al; U.S. Pat. No. 5,219,159, issued Jun. 15, 1993 to Malachowski and Kluger (citing numerous other patents); U.S. Pat. No. 5,337,133; and other cited patents.

Additional background of interest includes a Xerox Corp. U.S. Pat. No. 5,278,624, issued Jan. 11, 1994 to David R. Kamprath and Martin E. Hoover, showing another example of a "TELER" type of combined lateral sheet registration and deskewing system for a printer with a single drive motor and reduced mass of the "TELER" lateral translation (side shifting) components. Reduced mass is helpful to allow the re-centering or return to a "home" position of TELER systems in the very short time and space available between successive sheets in the sheet path of a high speed printer. That is because sheet lateral (side-shift) registration is accomplished in a TELER system by side-shifting the TELER sheet drive rolls and their associated components while the sheet is engaged in the feed nip of those TELER sheet drive rolls.

Also of particular background interest is a Xerox Corp. U.S. Pat. No. 5,078,384 issued Jan. 7, 1992 to Steven R. Moore. This is not a TELER system. Rather, it accomplishes sheet deskewing and downstream or forward direction registration by differential driving of two sheet drive rolls 24, 25, by two servomotors, but does not provide sheet lateral (sideways) registration by any side-shifting of those drive rolls. Thus, it does not teach or suggest (or even have the problem of) accomplishing rapid re-centering of a TELER system in between operative sheet nip engagements. However, this U.S. Pat. No. 5,078,384 does show the use of "D" shaped (partially relieved radius) drive rolls 24,25 to disengage those drive rolls from the sheet (opening the drive nip) when those drive rolls are rotated to the position in which the reduced radius "flat" portion of those "D" shaped drive rolls is facing the sheet and becomes spaced therefrom due it the reduced radius of that portion of the roll.

"D" shaped sheet feeding rolls are, of course, used in various other paper sheet feeding applications. For example, Xerox Corp. U.S. Pat. No. 5,449,165, issued Sep. 12, 1995, discloses a 90 degree paper feed transition module with transversely mounted and intermittently rotated "D" shaped feed rolls. Xerox Corp. U.S. Pat. No. 4,929,128, issued May 22, 1990 to Stemmle, shows typical segmented or "D" shaped feed rolls for initial sheet feeding, and for duplex path sheet feeding. However, the present embodiment provides normal and even closed nip sheet nip engagement and feeding, unlike such "D" roller sheet feed systems in which a stationary sheet is unevenly accelerated by initial engagement of a "corner" of the "D" roller (where the "D" roller transitions from it's smaller to it's larger radius) with the sheet.

There is a further, often unappreciated, problem in TELER systems, of particular interest here. A sheet which has just been accurately deskewed and laterally (side) registered by a TELER system cannot be released from the TELER nips until after that same sheet is firmly acquired by a downstream sheet transport in the paper path (normally a transfer station) which will prevent that sheet from losing the lateral registration and deskewed rotational orientation registration just given to that sheet by the TELER system. Thus, the timing of the release of the TELER nips is critically related not only to the time available and needed for re-centering before the next sheet is acquired (as noted above) but also to the timing of the acquisition of the sheet by the next downstream sheet transporting system.

Thus, in the disclosed embodiment, non-slip downstream sheet acquisition nips are specially positioned in relation to the TELER system feed rolls. In particular, in the disclosed embodiment, plural laterally spaced sheet positional stabilization roller nips are positioned downstream from the nips of "D" shaped TELER rollers (having a sheet engaging peripheral circumference area and a non-sheet engaging peripheral circumference area) by a distance downstream which is less than the circumference of the sheet engaging peripheral circumference area, to insure that the sheet will not be released from the sheet lateral and rotational registration position just provided by the TELER system. In the disclosed embodiment those plural laterally sheet positional stabilization roller nips are positioned in the paper path in between the TELER roller nips and the image transfer station of the printer, for further insuring of the maintenance of the side registration and deskewing of that sheet as that sheet is fed into the image transfer station. That is, in this embodiment the sheet is not released from its stabilizing nips until after at least a substantial portion of that sheet is fully acquired by the image transfer station. By "fully acquired" it is meant that a sufficiently substantial area of that sheet has been electrostatically tacked to the photoreceptor by transfer corona electrostatic charges (or acquired by a biased transfer roller nip with the photoreceptor) for further, non-slip, movement of that sheet by and with the moving photoreceptor, as will be well understood in the xerographic arts.

Various other prior automatic sheet lateral registration and deskewing systems are known in the art. The below-cited patent disclosures are noted by way of some further examples. They demonstrate the long-standing efforts in this technology for more effective yet lower cost sheet lateral registration and deskewing, particularly for printers (including, but not limited to, xerographic copiers and printers). They demonstrate that it has been known for some time to be desirable to have a sheet deskewing system that can be combined with a lateral sheet registration system, in a sheet driving system also maintaining the sheet forward speed and registration (for full three axis sheet position control) in the same apparatus. That is, it is desirable for both the sheet deskewing and lateral registration to be done while the sheets are kept moving along a paper path at a defined substantially constant speed. Otherwise known as sheet registration "on the fly" without sheet stoppages.

Yet these various prior systems have had some difficulties, which the novel system disclosed herein addresses, as further shown and described below. Especially, for the faster sheet feeding rates and decreased miss-registration tolerances of quality high speed printing systems.

For faster printing rates, requiring faster sheet feeding rates along paper paths, which can reach more than, for example, 100–200 pages per minute, the above combined systems and functions become much more difficult and expensive. Especially, to accomplish the desired sheet skew rotation, sheet lateral movement, and forward sheet speed during the brief time period in which each sheet is in the sheet driving nips of the combined system. As further discussed below, such high speed sheet feeding for printing or other position-critical applications heretofore has commonly required, for the lateral sheet registration, rapid acceleration and deceleration lateral (sideways to the sheet path) movements of relatively high mass system components, and substantial power for that rapid acceleration and rapid movement. Or, rapid "wiggling" of the sheet by deskewing, deliberately skewing, and again deskewing the sheet for side registration, during that same brief time period the sheet is held in the sheet feeding nips of the system. However, the sheet handling system disclosed herein is not limited to only high speed printing applications.

Disclosed in the embodiment herein is an improved system for controlling, correcting or changing the orientation and position of sheets traveling in a sheet transport path. In particular, but not limited thereto, sheets being printed in a reproduction apparatus, which may include sheets being fed to be printed, sheets being recirculated for second side (duplex) printing, and/or sheets being outputted to a stacker, finisher or other output or module.

The disclosed embodiment can provide in the same unit both active automatic variable sheet deskewing and active variable side shifting for lateral registration while the sheet is moving uninterruptedly at process speed. It is applicable to various reproduction systems, generally referred to herein as printers, including high-speed printers, and other sheet feeding applications.

Various other types of lateral registration and deskew systems are known in the art. A recent example is Xerox Corp. U.S. Pat. No. 6,173,952 B1, issued Jan. 16, 2001 to Paul N. Richards, et al (and art cited therein). That patents disclosed additional feature of variable lateral sheet feeding nip spacing, for better control over variable size sheets, may be readily combined with or into various applications of the present invention, if desired.

As noted, it is particularly desirable to be able to do lateral registration and deskew "on the fly," while the sheet is moving through or out of the reproduction system at normal process (sheet transport) speed. Also, to be able to do so with a system that does not substantially increase the overall sheet path length, or increase paper jam tendencies. The following additional patent disclosures, and other patents cited therein, are noted by way of some examples of sheet lateral registration systems with various means for side-shifting or laterally repositioning the sheet: Xerox Corp. U.S. Pat. No. 5,794,176, issued Aug. 11, 1998 to W. Milillo; U.S. Pat. No. 5,678,159, issued Oct. 14, 1997 to Lloyd A. Williams et al; U.S. Pat. No. 4,971,304, issued Nov. 20, 1990 to Lofthus; U.S. Pat. No. 5,156,391, issued Oct. 20, 1992 to G. Roller; U.S. Pat. No. 5,078,384, issued Jan. 7, 1992 to S. Moore; U.S. Pat. No. 5,094,442, issued Mar. 10, 1992 to D. Kamprath et al; U.S. Pat. No. 5,219,159, issued Jun. 15, 1993 to M. Malachowski et al; U.S. Pat. No. 5,169,140, issued Dec. 8, 1992 to S. Wenthe; and U.S. Pat. No. 5,697,608, issued Dec. 16, 1997 to V. Castelli et al. Also, IBM U.S. Pat. No. 4,511,242, issued Apr. 16, 1985 to Ashbee et al.

Various optical sheet lead edge and sheet side edge position detector sensors are known which may be utilized in such automatic sheet deskew and lateral registration systems. Various of these are disclosed the above-cited references and other references cited therein, or otherwise, such as the above-cited U.S. Pat. No. 5,678,159, issued Oct. 14, 1997 to Lloyd A. Williams et al; and U.S. Pat. No. 5,697,608 to V. Castelli et al.

Various of the above-cited and other patents show that it is well known to provide integral sheet deskewing and lateral registration systems in which a sheet is deskewed while moving through two laterally spaced apart sheet feed roller-idler nips, where the two separate sheet feed rollers are independently driven. Temporarily driving the two nips at slightly different rotational speeds provides a slight difference in the total rotation or relative pitch position of each feed roller while the sheet is held in the two nips. That moves one side of the sheet ahead of the other to induce a skew (small partial rotation) in the sheet opposite from an initially detected sheet skew in the sheet as the sheet enters the deskewing system. Thereby deskewing the sheet so that the sheet is now oriented with (in line with) the paper path.

For printing in general, the providing of both sheet skewing rotation and sheet side shifting while the sheet is being fed forward in the printer sheet path is a technical challenge, especially as the sheet path feeding speed increases. Print sheets are typically flimsy paper or plastic imageable substrates of varying thinness', stiffness', frictions, surface coatings, sizes, masses and humidity conditions. Various of such print sheets are particularly susceptible to feeder slippage, wrinkling, or tearing when subject to excessive accelerations, decelerations, drag forces, path bending, etc.

The above-cited Xerox Corp. U.S. Pat. No. 4,971,304, issued Nov. 20, 1990 to Lofthus (and various subsequent patents citing that patent, including the above-cited Xerox Corp. U.S. Pat. No. 6,173,952 B1, issued Jan. 16, 2001 to Paul N. Richards et al) are of interest as showing that a two nips differentially driven sheet deskewing system, as described above, can also provide sheet lateral registration in the same unit and system, by differentially driving the two nips to provide full three axis sheet registration with the same two drive rollers, plus appropriate sensors and software. That type of deskewing system can provide sheet lateral registration by deskewing (differentially driving the two nips to remove any sensed initial sheet skew) and then deliberately inducing a fixed amount of sheet skew (rotation) with further differential driving, and driving the sheet forward while so skewed, thereby feeding the sheet sideways as well as forwardly, and then removing that induced skew after providing the desired amount of sheet side-shift providing the desired lateral registration position of the sheet edge. This Lofthus-type system of integral lateral registration does not require rapid side-shifting of the mass of the sheet feed nips and their drives, etc., for lateral registration like a TELER type system. However, as noted, this Lofthus-type of lateral registration requires rapid plural rotations (high speed "wiggling") of the sheet. That has other challenges with increases in the speed of the sheet being both deskewed and side registered by plural differential rotations of the two nips, requiring additional controlled differential roll pair driving, especially for large or heavy sheets.

In contrast to the above-described Lofthus '304 type system of sheet lateral registration are prior TELER type sheet side-shifting systems, in which the entire structure and mass of the carriage containing the two drive rollers, their opposing nip idlers, and the drive motor(s) (unless, e.g., the drive motor(s) are splined drive telescopically connected), is axially side-shifted to side-shift the engaged sheet into lateral registration. In the latter systems the sheet lateral registration movement can be done during the same time as, but independently of, the sheet deskewing movement, thereby reducing the above-described sheet rotation requirements. These may be broadly referred to as "TELER" systems, of, e.g., U.S. Pat. No. 5,094,442, issued Mar. 10, 1992 to Kamprath et al; U.S. Pat. Nos. 5,794,176 and 5,848,344 to Milillo et al; U.S. Pat. No. 5,219,159, issued Jun. 15, 1993 to Malachowski and Kluger (citing numerous other patents); U.S. Pat. No. 5,337,133; and other above-cited TELER patents and applications.

For high speed sheet feeding, however, a rapid lateral acceleration and deceleration of a substantial mass in such prior TELER systems requires yet another fairly large drive motor to accomplish the side shift in the brief time period in which the sheet is still held in (but passing rapidly through) the pair of drive nips and then rapidly re-center that mechanism by a reverse side-shift movement in the typically very much briefer time period available before the next sheet reaches the two nips of the TELER system. That is, the entire deskew mechanism of two independently driven transversely spaced feed roll nips and their mounting carriage must move laterally by a variable distance each time an incoming sheet is optically detected as needing lateral registration, by the amount of side-shift needed to bring that sheet into lateral registration. Then the entire TELER side-shifting system must return even faster, re-centering after each sheet or after a series of sheets have required a series of side shifts in the same direction by a predetermined excessive total distance. That is, an even more rapid opposite transverse return movement of the same large mass is required in prior TELER systems in order to return the system back to its "home" or centered position before the (closely following) next sheet enters the two drive nips of the system.

Especially if each sheet is entering the system laterally miss-registered in the same direction, as can easily occur, for example, if the input sheet stack side guides are not in accurate lateral alignment with the machines intended alignment path, which is typically determined by the image position of the image to be subsequently transferred to the sheets.

In any of these systems, the use of sheet position sensors, such as a CCD multi-element linear strip array sensor, may be used in a feedback loop for slip compensation to insure the sheet achieving the desired three-axis registration. See, e.g., the above-cited U.S. Pat. No. 5,678,159 to Lloyd A. Williams, et al.

Also, the disclosed embodiment does not require pivoting nips, which have other issues, and allows the use of otherwise normal low slippage high friction feed rollers which may provide normal roller-width sheet engagement in the sheet feeding nips with an opposing idler roller.

Although the drive systems illustrated in the example herein are shown in a direct drive configuration, that is not required. For example, a timing belt or gear drive with a drive ratio could be alternatively used.

A specific feature of the specific embodiment disclosed herein is to provide a sheet lateral registration system for sequentially laterally registering and feeding sheets moving in a sheet path direction, comprising at least two spaced apart sheet feeding rollers providing defined intermittent sheet engagement and sheet disengagement nips, a rotatable drive system for said at least two spaced apart sheet feeding rollers, a lateral shifting system for laterally moving a sheet by laterally shifting said at least two spaced apart sheet feeding rollers laterally relative to said sheet path direction while a sheet is engaged in said intermittent sheet engagement nips of said at least two sheet feeding rollers, and said lateral shifting system having a home position and intermittently laterally shifting said at least two spaced apart sheet feeding rollers towards said home position of said lateral shifting system without laterally moving said sheet while a sheet is in said intermittent sheet disengaged nips of said at least two sheet feeding rollers.

Further specific features disclosed in the embodiment herein, individually or in combination, include those wherein said at least two spaced apart sheet feeding rollers provide said defined intermittent sheet engagement and sheet disengagement nips by said at least two sheet feeding rollers having at least two different radii in at least two different circumferential areas which alternately engage and disengage the sheet as said at least two sheet feeding rollers are rotated by said rotatable drive system to provide increased time for said laterally shifting of said at least two sheet feeding rollers towards said home position of said lateral shifting system by disengaging from a sheet substantially before the sheet leaves said sheet lateral registration system, and/or wherein opposing idlers are mounted for lateral movement together with said at least two spaced apart sheet feeding rollers, and said two spaced apart sheet feeding rollers have similar major larger radius cylindrical circumferential lengths and minor smaller radius non-cylindrical circumferential lengths respectively automatically providing with said rotation thereof closed nip sheet feeding and open nip sheet release relative to said opposing idlers, and/or wherein said larger radius circumferential lengths of said at least two spaced apart sheet feeding rollers are coordinated to the downstream distance to a subsequent sheet acquisition system, and/or wherein said sheet lateral registration system is integral a high speed printer with an image transfer station in said sheet path, said high speed printer having a subsequent sheet acquisition system comprising non-slip sheet feeding nips positioned in said sheet path between said sheet lateral registration system and said image transfer station of said high speed printer, and/or wherein said at least two spaced apart sheet feeding rollers provide sheet deskewing by differential rotation as well as said lateral sheet registration, and/or wherein said sheet lateral registration system is integral a high speed printer sheet path having closely sequentially spaced print media sheets moving at high speed therein, and said sheet lateral registration system provides lateral registration of said print media sheets, and/or wherein said at least two spaced apart sheet feeding rollers have opposing idlers, said at least two spaced apart sheet feeding rollers provide said defined intermittent sheet engagement and sheet disengagement nips by said at least two sheet feeding rollers having at least first and second different radii in at least first and second different circumferential areas which respectively alternately engage and disengage opposing idlers to provide respective opened and closed sheet feeding nips as said at least two sheet feeding rollers are rotated by said rotatable drive system, said opened sheet feeding nips provide said increased time for said laterally shifting of said at least two sheet feeding rollers towards said home position of said lateral shifting system by disengaging from a sheet substantially before the sheet leaves said sheet lateral registration system, and said defined intermittent sheet engagement nips are automatically closed before a sheet is received therein, and/or a sheet lateral registration system for sequentially laterally registering and feeding sheets moving in a sheet path direction with at least two laterally spaced apart sheet feeding and registration rollers forming sheet feeding nips with opposing idlers, said at least two laterally spaced apart sheet feeding and registration rollers are laterally moveable relative to said sheet path direction towards and away from a lateral home position, said at least two laterally spaced apart sheet feeding and registration rollers have at least first and second different circumferential surface areas, respectively, having a larger radius and a smaller radius, a roller rotational drive system selectively intermittently partially rotates said at least two sheet feeding and registration rollers to intermittently form a closed sheet feeding nip with said first and larger radius circumferential surface areas with said idlers, said roller rotational drive system selectively intermittently further partially rotating said at least two sheet feeding and registration rollers to intermittently form an open non sheet feeding gap from said idlers with said second and smaller radius of said second circumferential surface areas, a lateral movement system for intermittently laterally shifting said at least two spaced apart sheet feeding rollers laterally relative to said sheet path direction while a sheet is engaged in said closed sheet feeding nip of said at least two sheet feeding rollers for laterally registering the sheet, and said lateral movement systems intermittently laterally shifting said at least two spaced apart sheet feeding rollers towards said home position thereof without laterally moving a sheet while a sheet is in said intermittent sheet disengaged nips of said at least two sheet feeding rollers to provide increased time for said laterally shifting of said at least two sheet feeding rollers towards said home position, and/or a sheet lateral registration method for sequentially laterally registering and feeding sheets moving in a sheet path direction with at least two laterally spaced apart sheet feeding and registration rollers forming sheet feeding nips with opposing idlers, said at least two laterally spaced apart sheet feeding and registration rollers being laterally moveable relative to said sheet path direction towards and away from a lateral home position, said at least two laterally spaced apart sheet feeding and registration rollers having at least first and second different circumferential surface areas respectively having a larger radius and a smaller radius, selectively intermittently partially rotating said at least two sheet feeding and registration rollers to intermittently form a closed sheet feeding nip with said first and larger radius circumferential surface areas with said idlers, selectively intermittently further partially rotating said at least two sheet feeding and registration rollers to intermittently form an open non sheet feeding gap from said idlers with said second and smaller radius of said second circumferential surface areas, intermittently laterally shifting said at least two spaced apart sheet feeding rollers laterally relative to said sheet path direction while a sheet is engaged in said closed sheet feeding nip of said at least two sheet feeding rollers for laterally registering the sheet, and intermittently laterally shifting said at least two spaced apart sheet feeding rollers towards said home position thereof without laterally moving a sheet while a sheet is in said intermittent sheet disengaged nips of said at least two sheet feeding rollers to provide increased time for said laterally shifting of said at least two sheet feeding rollers towards said home position, and/or wherein said opposing idlers laterally move together with said at least two spaced apart sheet feeding rollers, and said two spaced apart sheet feeding rollers have similar major larger radius cylindrical circumferential lengths and minor smaller radius non-cylindrical circumferential lengths respectively automatically providing with said rotation thereof closed nip sheet feeding and open nip sheet release relative to said opposing idlers, and/or wherein said larger radius circumferential lengths of said at least two spaced apart sheet feeding rollers are greater than the downstream distance to a subsequent sheet acquisition system, and/or a high speed printer with an image transfer station in said sheet path, having a sheet acquisition system downstream in said sheet path comprising non-slip sheet feeding nips positioned in said sheet path between said sheet lateral registration method and said image transfer station of said high speed printer, wherein said at least two spaced apart sheet feeding rollers provide sheet deskewing by differential rotation as well as said lateral sheet registration, and/or wherein said at least two spaced apart sheet feeding rollers are integral a high speed printer sheet path having closely sequentially spaced print media sheets moving at high speed therein, and said at least two spaced apart sheet feeding rollers provide both lateral registration and deskewing of said closely sequentially spaced print media sheets.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed. A "copy sheet" may be abbreviated as a "copy" or called a "hardcopy."

As to specific components of the subject apparatus or methods, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the apparatus and its operation or methods described in the example below, and the claims. Thus, the present invention may be better understood from this description of this specific embodiment, including the drawing figures (which are approximately to scale) wherein:

Figure 2:
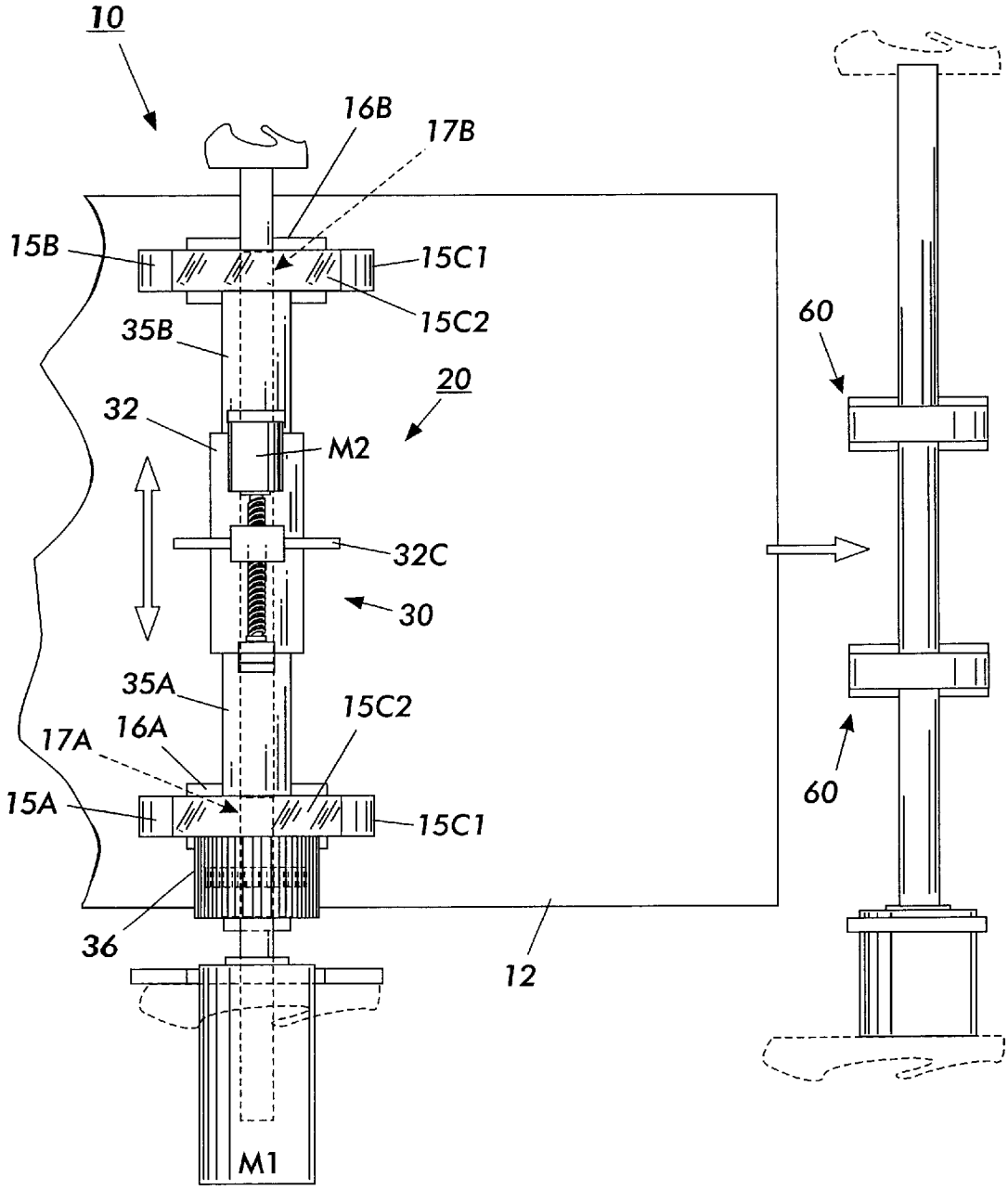
FIG. 2 is a more detailed and bottom view of the TELER system embodiment of FIG. 1, with the sheet baffles removed for illustrative clarity.
Figure 3:
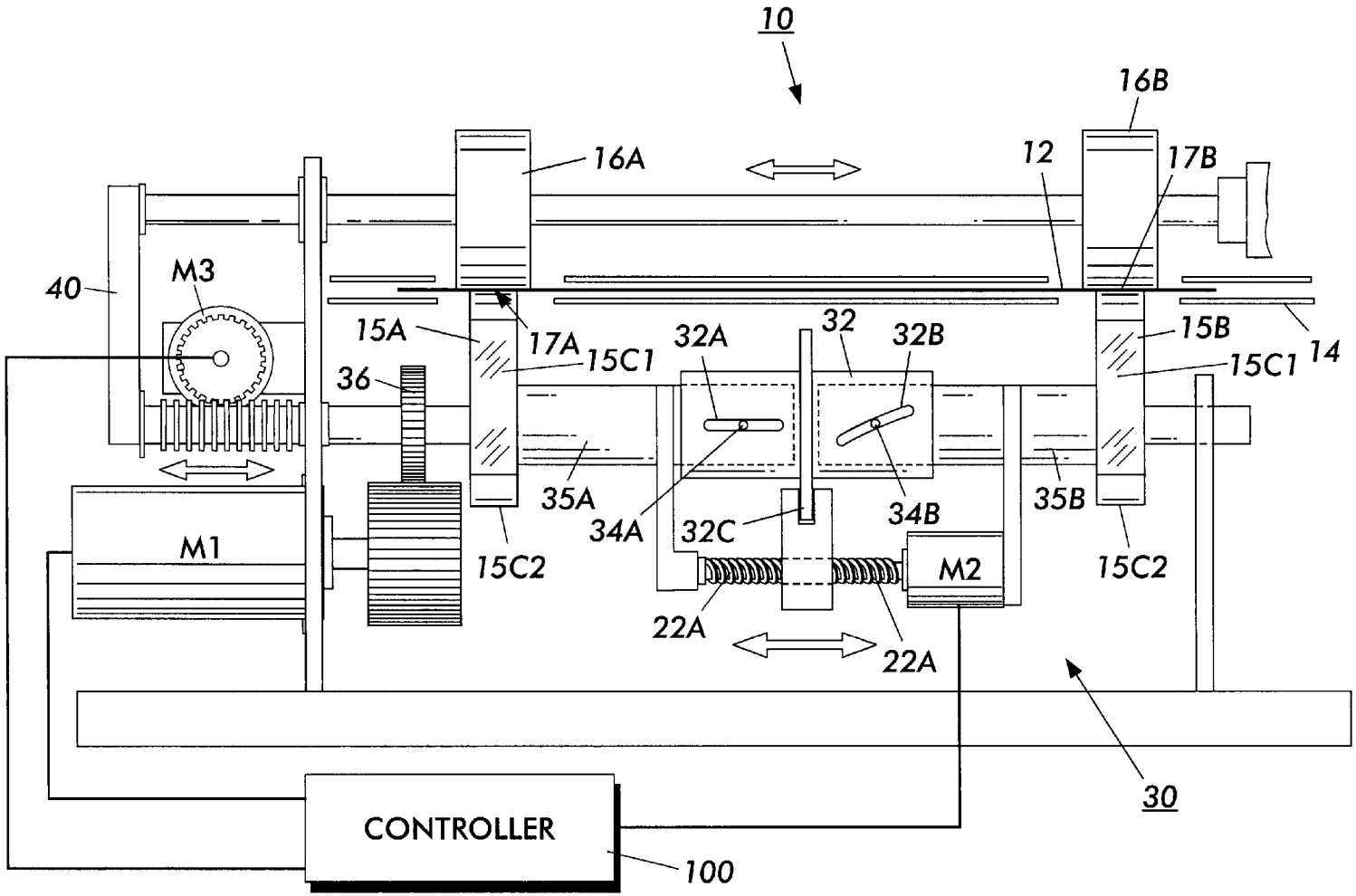
Figure 4:
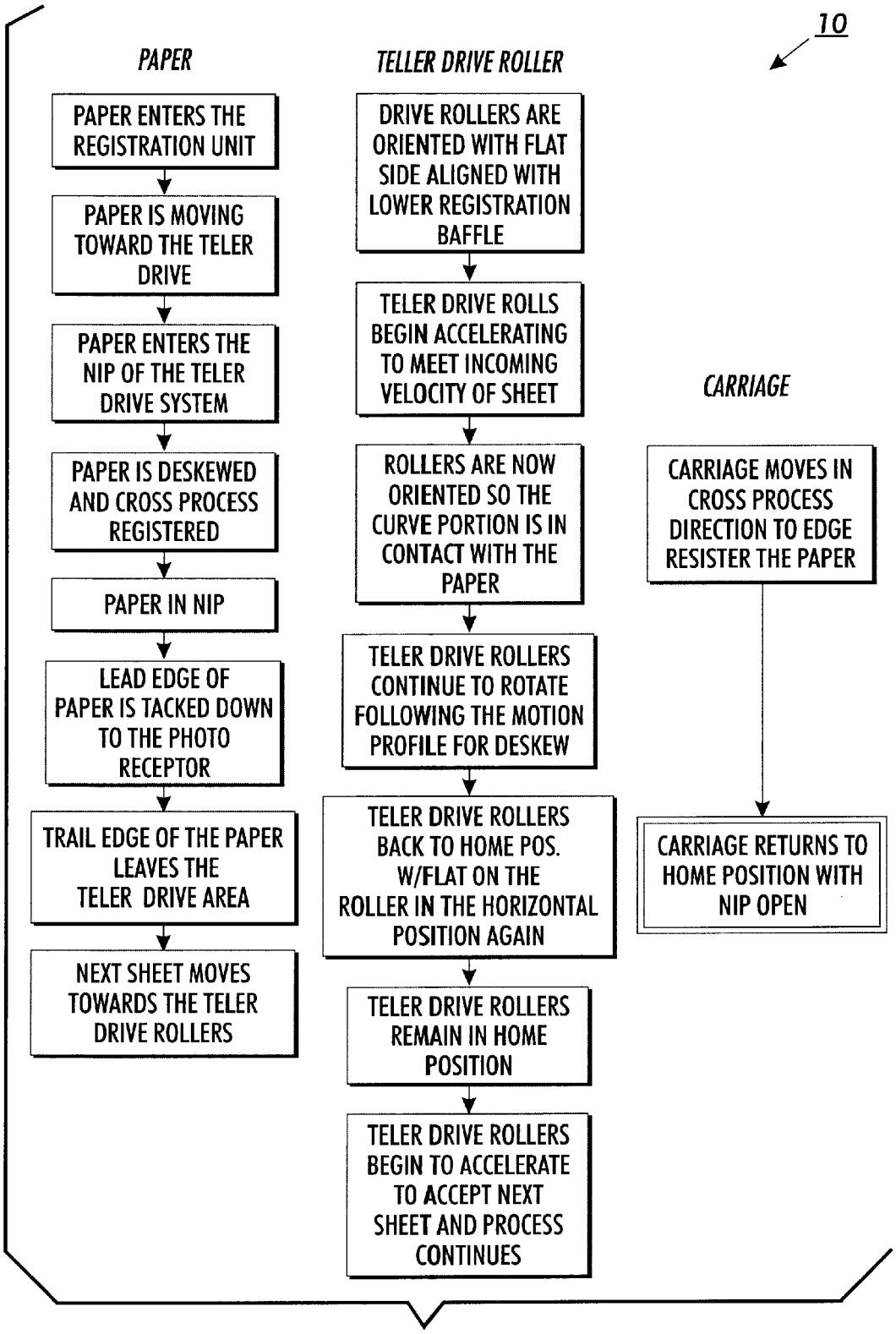

FIG. 3 is a plan or end view (as if cut through the paper path) of the TELER system embodiment of FIG. 2; and FIG. 4 is a flow chart showing exemplary respective operating or processing steps occurring at about the same respective time for the sheet, the TELER rollers, and the TELER side shifting carriage, in a modification of the above exemplary TELER system without a pre-transfer registration maintenance nip, that is, an alternative embodiment in which the TELER system is feeding each sheet directly into the image transfer system.

Describing now in further detail these exemplary embodiments with reference to the Figs, as discussed above and as taught by the above and other references, such sheet deskewing and lateral registration systems 10 may be installed in a selected location or locations of the paper path or paths of various printing machines, for sequentially deskewing the print media sheets 12. Hence, only a portion of exemplary baffles 14 partially defining an exemplary printer 10 paper path need be illustrated here.

In this example there is shown two laterally spaced sheet drive rollers 15A, 15B, a single servo-motor M1 drive for both, and mating idler rollers 16A, 16B forming first and second TELER nips 17A, 17B with the drive rollers 15A, 15B. Also shown in this embodiment is a small, low cost, low power, differential actuator drive motor M2. As will be described, the operation of M2 can differentially vary the relative rotational positions or pitch of the drive rollers 15A, 15B to impart a small rotational movement to sheet 12 for deskewing the sheet 12.

As previously described, the two drive nips 17A, 17B are normally driven by M1 at the same rotational speed to feed the sheet 12 in those nips downstream in the paper path at the process speed, except when the need for deskewing that sheet 12 is detected by the above-described and cited or other conventional optical sensors (which need not be shown here). That is, detecting when the sheet 12 has arrived in the deskewing system in a skewed condition needing deskewing. In that case, as further above described and reference-cited, deskew is accomplished by a corresponding pitch change made by a sheet driving difference between the two drive roller 15A, 15B rotary positions during the time the sheet 12 is passing through, and held in, the two sheet feeding nips 17A, 17B.

As further described in the above cross-referenced application, and the above-cited U.S. Pat. No. 5,278,624, in this example only a single servo-motor M1 is needed to drive both drive rollers 15A, 15B even though, as noted above, their sheet driving must differ slightly to provide said differential sheet driving in the nips 17A, 17B for sheet deskew.

It will be appreciated that for a combined deskew and lateral registration system that these and other deskewing systems (or only key components thereof, as shown here) may simply be mounted on simple rotary slide bearings or lateral rails, rods or carriages so as to be laterally driven by any of various such direct or indirect driving connections with another servo-motor, such as M3 and its pinion drive shown here in FIG. 3. Various alternative side-shifting systems are disclosed in various of the above-cited and other patents, and need not be repeated herein. All of the various motions of this system 10 may be conventionally controlled as described herein or otherwise from a conventional microprocessor 100 with programmed software and need not be described in detail herein.

As shown in the example of FIG. 3, and the above cross-referenced application, paper deskewing by differential nip action as previously described above may be accomplished through a simple and low cost differential mechanism system 30. Here, that differential system 30 comprises a pin-riding helically slotted sleeve connector 32 which is laterally transposed by the small low cost differential motor M2. This particular example is a tubular sleeve connector 32 having two slots 32A, 32B, at least one of which is angular, partially annular or helical. These slots 32A, 32B respectively slideably contain the respective projecting pins 34A, 34B of the ends of the respective split co-axial drive shafts 35A, 35B over which the tubular sleeve connector 32 is slideably mounted. Each drive roller 15A, 15B is mounted to, for rotation with, a respective one of the drive shafts 35A, 35B. One of those drive shafts, 34A here, is driven by the motor M1, here through the illustrated splined or laterally slidable gear drive 36, although it could be driven differently or even directly. The two drive shafts 35A, 35B may themselves be tubular, to further reduce the moving system mass. The helical slot differential drive tube or sleeve 32 is mounted to slide over (back and forth on) the inner ends of both drive tubes 35A, 35B.

This variable pitch differential connection mechanism 30 enables a paper registration system with only one forward drive motor M1 to positively drive both nips 17A and 17B. Only the fixed position motor M1 needs to have the necessary power to propel the paper in the forward direction, while the second much smaller and lighter motor M2 does not need to drive the sheet forward. The motor M2 only needs to provide enough power to operate the differential system 30 to correct for the sheet skew. That differential system 30 is small, accurate, inexpensive, and requires little power to operate. It may be actuated by any of numerous possible simple mechanisms simply providing a short linear movement. Here, the motor M2 rotates a lead screw 22A by a selected amount to laterally move the tubular sleeve 32 by engagement with its projecting flange or arm 32C. That changes via the angle of the slot 32B the relative angular positions of the two pins 34A, 34B, and thereby correspondingly changes the relative angular positions of their two shafts 35A, 35B, and thereby differentially rotates one drive roller 15B relative to the other drive roller 15A to provide the desired deskewing of the sheet 12 by that difference. Yet both rollers 15A and 15B otherwise continue to be driven, to drive the sheet 12 in the process direction at the same speed, by the motor M1, because the sleeve 32 is positive drive connecting shaft 35A to shaft 35B by the pins 34A and 34B engaged in the slots 32A and 32B of their shared sleeve 32. Note that this skew correction may have a predictable associated forward displacement, which may be corrected by a slight change in the forward motor M1 drive speed.

The opposing idlers 16A, 16B defining the two sheet drive nips 17A, 17B may be conventionally mounted on a undriven shaft. As show in the FIG. 3 example, they may be connected in any suitable manner such as connection 40 for common lateral side shifting by the same side registration drive motor M3. Suitable spring or other normal force means may be provided for the desired nip force in a conventional manner. It will also be appreciated that the illustrated system components may be vertically reversed, with the idlers 16A, 16B mounted below the paper path and the two drive rollers 15A, 15B mounted above the paper path.

Periodically (after every sheet or after several sheets, or as necessary), the helical slot drive tube 32 may be re-centered by M2 to its home position, with the pins 34A, 34B approximately centered in their slots 32A, 32B, to prevent the tube 32 from going too far to one side, or against its lateral end stops, which here are defined by the ends of the slots 32A, 32B. This may take place in between the sequential sheets in the sheet path, when no sheet 12 is in the nips. However, as will be described, in the system 10 here there is a greatly increased time for this re-centering (as well as the TELER side-shift system M3 re-centering) that is provided by the sheet 12 release by the non-nip or "flats" portion 15C2 of the "D" shaped rollers 15A, 15B.

The addition of lateral sheet registration movement to the deskew and process direction sheet movement requires, as described, movement of the nips with their shafts in the axial (transverse) direction. If the skew motor M2 were fixedly mounted to the machine base and connected to the helical slot drive tube 32, the lateral movement of the system for lateral registration would introduce an unintended coupled relative displacement of the helical slot drive tube 32, resulting in skew error. This can be avoided in several different ways, such as, in FIG. 3, the mounting of the motor M2 to the shaft section 35B, or, as in the system of FIG. 6 of the above cross-referenced and incorporated application, stationarily mounted to the machine frame and laterally moving the helical slot drive tube 32 indirectly by a cable or other connection coordinated with the side-shifting of the system 10. Thus, the relative position of the helical slot drive tube 32 with the pins 34A, 34B is maintained, and skew is not affected, by the lateral sheet 12 registration movement of the TELER nips 17A, 17B.

As noted above, for sheet lateral registration the shaft of the idlers 16A, 16B here may be connected by a simple connection such as 40 in FIG. 3, so that the idlers 16A, 16B move laterally the same as the rollers 15A, 15B, so that the nips 17A and 17B may move laterally. In effect, in this example 40 of FIG. 3 there is a U-shaped configuration of those two shafts and their interconnecting member 40, that can be moved laterally like a trombone tube by the servo-motor M3 or otherwise, through simple slide bearings for both shafts, thereby not requiring a heavy lateral movement carriage for TELER sheet lateral registration.

As shown in this example of FIG. 3, the servo-motor M3 may transversely drive the above TELER side-shifting unit by a simple pinion gear on M3 meshing with a multiply cylindrically toothed or grooved rack on the TELER drive rollers shaft. This allows the motor M1 to rotatably drive that same shaft (to provide the sheet forward drive and process direction registration) independently of the transverse movement thereof by M3 for side-shifting the sheet for it's lateral registration (and then re-centering the unit) or vice versa.

It may be seen in FIGS. 2 and 3 that the main drive motor M1 may be mounted to the frame and also does not need to be part of the laterally moved mass for lateral sheet registration. That is enabled here by the width of the drive gear in the gear drive 36, allowing the driven gear to move laterally with its shaft 35A relative to the driving gear without losing driving engagement.

Thus, any or all of the three motors M1, M2 and M3 here may be fixed, and none or only one (M2) need move laterally, only the above-described TELER nips and shafts components. This greatly reduces the movement mass and required movement power for lateral sheet registration. By all the motors being mounted to the frame of the machine, that also increases system rigidity and improves electrical connections. Furthermore, it may be seen that a moving carriage or frame is not required here either. This further reduces the mass and the power requirements for the lateral motor M3 and enables easier or faster acceleration and deceleration.

Figure 1:
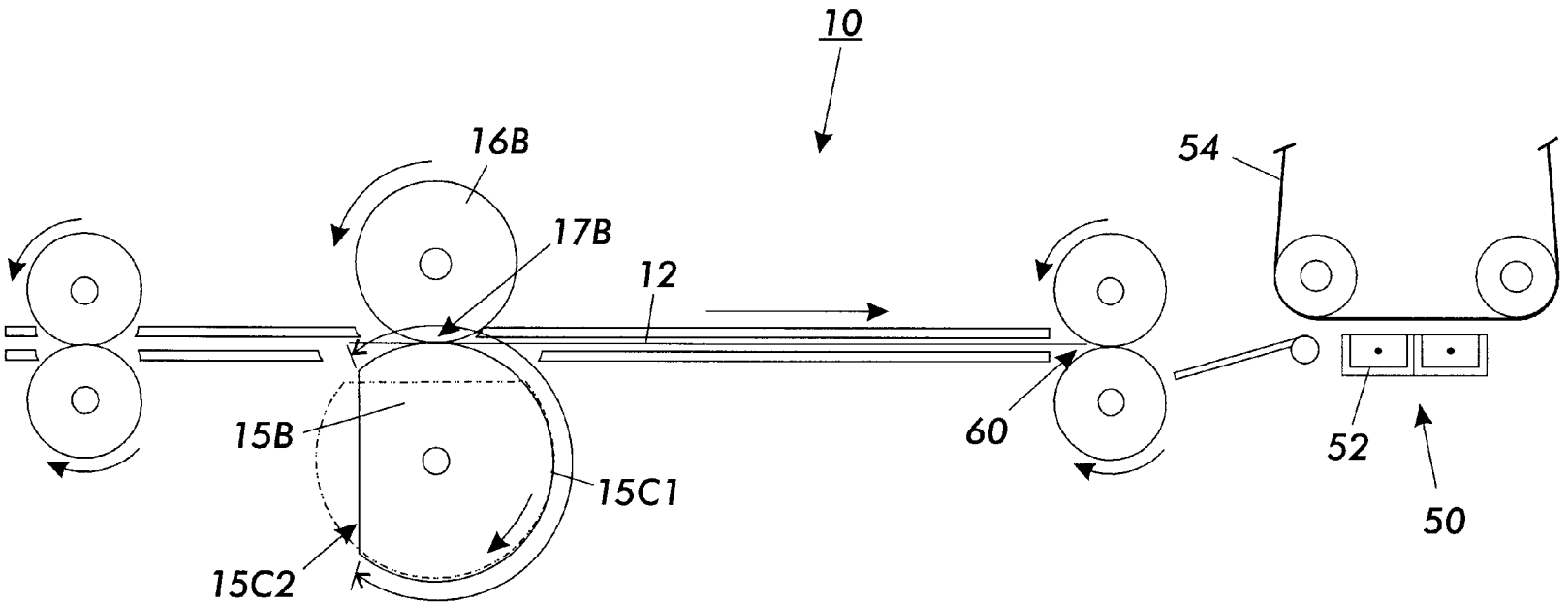
FIG. 1 is a partially schematic plan view, taken transversely of an exemplary printer paper path, of one example of a "TELER" type of dual nip combined automatic differential deskewing and side shifting lateral registration system, with "D" shaped nip-disengaging TELER rollers and an operatively and dimensionally associated downstream pre-transfer registration maintenance nip.

Referring now to FIG. 1 in particular, the "D" shape of the sheet drive roller 15B (and 15B is the same as 15A here) of this system 10 may seen in a side view, and the relative dimensions or the two different circumferential distances 15C1 and 15C2 of the two different radius portions of each "D" shaped roller will be discussed. That is, the "D" shaped rollers 15A, 15B both have a larger and uniform radius (cylindrically shaped) sheet engaging peripheral circumference 15C1, and a smaller radius non sheet engaging peripheral circumference 15C2. To express that in other words, 15C2 represents the rotational length of the "flat" or reduced radius portion of the "D" shaped roller 15B by which the nip 17B is released whenever the roller 15B is rotated into a position where that reduced radius portion 15C2 of the roller is facing towards the sheet 12 and the idler roll 16B. Note that while it may be referred to as the "flat," as shown in the above-cited U.S. Pat. No. 5,078,384, for example, this area 15C2 need not actually be flat, merely have a smaller radius.

Also in this embodiment 10 (referring especially to FIG. 1, but also FIG. 2) there is disclosed an alternative to the normal practice,(as in FIG. 4) of the TELER system nips 17A, 17B feeding the sheet 12 directly into an image transfer station 50 (for transfer corona source 52 electrostatic tacking of the sheet 12 to the printer photoreceptor 54 or image transfer belt). In this example 10, the TELER system nips 17A, 17B instead feed the sheet 12 into fixed roller nips 60 which are positioned in between the TELER system nips 17A, 17B and the image transfer station 50. More specifically, these roller nips 60 are positioned downstream by a distance from the TELER nips in relation to the engaged-nip circumferential length 15C1 of these "D" shaped TELER system feed rolls 15A, 15B. In particular, these plural spaced sheet positional stabilization roller nips 60 may be positioned downstream from the nips 17A, 17B of "D" shaped TELER rollers 15A, 15B by a distance downstream from those nips which is less than the circumference length 15C1 of the sheet engaging peripheral circumference area, and, of course, the shortest sheet dimension in the process direction. These conventional non-slip roller nips 60 can capture and prevent the sheet 12 from losing any of the 3-axis registration just given to the sheet 12 by the upstream TELER system nips 17A, 17B as soon as the lead edge of the sheet enters those nips 60. The nips 60 then can hold and maintain the sheet 12 three axis registration while further feeding the sheet 12 on into the image transfer station 50 until a sufficient area of the sheet is sufficiently electrostatically tacked to the photoreceptor 54 by transfer charges 52 for that adhesion force to provide non-slip further sheet feeding by the photoreceptor 54.

Meanwhile, previously, the TELER nips 17A,17B have opened automatically by further rotation of the rollers 15A, 15B to their reduced radius areas 15C2. This can be designed to occur any time after the sheet 12 has been fully acquired by the next downstream sheet acquisition system. If that downstream sheet acquisition system is the transfer system 50, the large nip forming circumference distance 15C1 may be made approximately equal to the downstream paper path distance from that nip to the position on the photoreceptor where the sheet will be sufficiently tacked. With the addition of the nips 60 in the example 10, the nip opening may be well before the sheet is fed into the transfer system 50. The opposing idlers 16A, 16B are mounted, and/or have stops, so as not to move substantially into the opened nips 14A, 17B. It will be appreciated that if sheet deskewing was also being done by differential driving of those same two "D" shaped registration rollers that their two nips may open at slightly different times and rotary positions. Accommodation may readily made for not laterally re-centering until the last nip to open even under maximum deskew conditions.

The nips 14A, 17B will preferably be accelerated up to the process (paper path) speed and re-closed (by restarting the rotation of the rollers 15A, 15B and rotating them sufficiently to re-engage the opposing idlers 16A, 16B), before the lead edge of the next sheet enters the nip. That is to insure normal and even sheet nip engagement and feeding. In particular, this is unlike many other "D" roller sheet feed systems, in which a stationary sheet is unevenly accelerated by initial engagement of a "corner" of the "D" roller (where the "D" roller radius transitions from it's smaller to it's larger radius) with the sheet.

The nips 60 may positioned sufficiently close to the image transfer station 50 in the process (paper path movement) direction that a substantial area of the shortest sheet dimension to be fed in the paper path (a preset machine parameter) may be fully acquired by the transfer station 50 before that sheet is released from the nips 60.

It will be appreciated by those skilled in the art that two or more laterally spaced frictional sheet drive roller/idler nips 60, of the type conventionally used in various other portions of a printer sheet path, are far more resistant to sheet slippage that would allow sheet skewing or other misregistration than the electrostatic tacking of only a minor leading area of a sheet to a photoreceptor or other image bearing surface.

The following is one example of a calculation for the relative dimensions of exemplary TELER rollers 15A and 15B for two different radius areas 15C1 and 15C2 (for closed nips and open nips, respectively). Assume the predetermined smallest sheet dimension in the process (paper path) direction will 140 mm or 5.5 inches. Further assume that the total circumference "c" ($=2\pi r$) of the TELER roller will be measured using 200 steps per roller revolution, and that Twenty-five of those steps are desired for the lateral acceleration and deceleration of the TELER side-shifting system for re-centering the TELER system, or 50 steps total of desired TELER roller rotation (and circumferential length) nip release.

Then: 50 steps divided by 200 steps=¼c or 0.25c or $0.75\times2\pi r$=15C2, which is the portion of the TELER roller total circumference "c" that needs to be modified with a reduced radius to provide the desired amount of nip release in this example.

Thus, the remainning, unmodified, full radius portion 15C1 of the TELER roller circumference "c" in this example is ¾c or 0.75c or $0.75(2\pi r)$. This is, the desired sheet movement distance, which equals the amount of the full radius sheet-engaging circumference 15C1 on the TELER roller. This $0.75(2\pi r)$ calculation allows calculation of the TELER roller radius r to provide this desired circumference distance 15C1.

It will be appreciated that such TELER "D" rollers may need to have a larger radius than other TELER drive rolls so that only one (partial) revolution of the full radius portion 15C1 of the TELER roller circumference "c" will positively feed the shortest sheet being fed into the next downstream sheet feeding nip or other positive acquisition. That is, "c" must be longer than the distance between its own upstream nip and the next downstream nip. To express it another way, plural revolutions of smaller circumference rollers cannot be used for that function as in the prior art of fully cylindrical sheet feed rollers. Thus, in a high speed system, it may be desirable to design such larger radius "D" shaped rollers with a lower moment of rotational interia and angular momentum by conventional designs and/or lower density outer materials therefor.

In conclusion, by automatically opening the registration roller nips (simply by their continued rotation) after sheet lateral registration but substantially before the trailing end of the sheet being registered has passed through those nips, the exemplary or other lateral registration system is immediately then free to re-center, that is, to return to wherever its desired lateral "home" position is. (That home position may differ, e.g., between sheet center registered printers and front or rear edge registration printers.) A greatly increased time period is available for this motion, and thus lower acceleration and deceleration is possible. This can improve accuracy as well as reduce the force and power requirements on the lateral motion system (such as M3 in the above example), and/or allow a higher mass lateral movement unit, or greater initial sheet misregistration, even for high speed printing. These features and advantages are particularly desirable in a system also providing automatic deskew of the sheet at the same time and with the same unit as for said lateral sheet registration, as in the examples herein, but are not limited thereto.

While the embodiments disclosed herein are preferred, various other presently unknown or unappreciated equivalents are also intended to be encompassed by the following claims.

What is claimed is:

1. A sheet lateral registration system for sequentially laterally registering and feeding sheets moving in a sheet path direction, comprising:

at least two spaced apart sheet feeding rollers providing defined intermittent sheet engagement and sheet disengagement nips, a rotatable drive system for said at least two spaced apart sheet feeding rollers, a lateral shifting system for laterally moving a sheet by laterally shifting said at least two spaced apart sheet feeding rollers laterally relative to said sheet path direction while a sheet is engaged in said intermittent sheet engagement nips of said at least two sheet feeding rollers, and said lateral shifting system having a home position and intermittently laterally shifting said at least two spaced apart sheet feeding rollers towards said home position of said lateral shifting system without laterally moving said sheet while a sheet is in said intermittent sheet disengaged nips of said at least two sheet feeding rollers.

2. The sheet lateral registration system of claim 1, wherein said at least two spaced apart sheet feeding rollers provide said defined intermittent sheet engagement and sheet disengagement nips by said at least two sheet feeding rollers having at least two different radii in at least two different circumferential areas which alternately engage and disengage the sheet as said at least two sheet feeding rollers are rotated by said rotatable drive system to provide increased time for said laterally shifting of said at least two sheet feeding rollers towards said home position of said lateral shifting system by disengaging from a sheet substantially before the sheet leaves said sheet lateral registration system.

3. The sheet lateral registration system of claim 1, wherein opposing idlers are mounted for lateral movement together with said at least two spaced apart sheet feeding rollers, and said two spaced apart sheet feeding rollers have similar major larger radius cylindrical circumferential lengths and minor smaller radius non-cylindrical circumferential lengths respectively automatically providing with said rotation thereof closed nip sheet feeding and open nip sheet release relative to said opposing idlers.

4. The sheet lateral registration system of claim 3, wherein said larger radius circumferential lengths of said at least two spaced apart sheet feeding rollers are coordinated to the downstream distance to a subsequent sheet acquisition system.

5. The sheet lateral registration system of claim 1, wherein said sheet lateral registration system is integral a high speed printer with an image transfer station in said sheet path, said high speed printer having a subsequent sheet acquisition system comprising non-slip sheet feeding nips positioned in said sheet path between said sheet lateral registration system and said image transfer station of said high speed printer.

6. The sheet lateral registration system of claim 1, wherein said at least two spaced apart sheet feeding rollers provide sheet deskewing by differential rotation as well as said lateral sheet registration.

7. The sheet lateral registration system of claim 1, wherein said sheet lateral registration system is integral a high speed printer sheet path having closely sequentially spaced print media sheets moving at high speed therein, and said sheet lateral registration system provides lateral registration of said print media sheets.

8. The sheet lateral registration system of claim 1, wherein;

said at least two spaced apart sheet feeding rollers have opposing idlers, said at least two spaced apart sheet feeding rollers provide said defined intermittent sheet engagement and sheet disengagement nips by said at least two sheet feeding rollers having at least first and second different radii in at least first and second different circumferential areas which respectively alternately engage and disengage opposing idlers to provide respective opened and closed sheet feeding nips as said at least two sheet feeding rollers are rotated by said rotatable drive system, said opened sheet feeding nips provide said increased time for said laterally shifting of said at least two sheet feeding rollers towards said home position of said lateral shifting system by disengaging from a sheet substantially before the sheet leaves said sheet lateral registration system, and said defined intermittent sheet engagement nips are automatically closed before a sheet is received therein.

9. In a sheet lateral registration system for sequentially laterally registering and feeding sheets moving in a sheet path direction with at least two laterally spaced apart sheet feeding and registration rollers forming sheet feeding nips with opposing idlers;

said at least two laterally spaced apart sheet feeding and registration rollers are laterally moveable relative to said sheet path direction towards and away from a lateral home position, said at least two laterally spaced apart sheet feeding and registration rollers have at least first and second different circumferential surface areas respectively having a larger radius and a smaller radius, a roller rotational drive system selectively intermittently partially rotates said at least two sheet feeding and registration rollers to intermittently form a closed sheet feeding nip with said first and larger radius circumferential surface areas with said idlers, said roller rotational drive system selectively intermittently further partially rotating said at least two sheet feeding and registration rollers to intermittently form an open non sheet feeding gap from said idlers with said second and smaller radius of said second circumferential surface areas, a lateral movement system for intermittently laterally shifting said at least two spaced apart sheet feeding rollers laterally relative to said sheet path direction while a sheet is engaged in said closed sheet feeding nip of said at least two sheet feeding rollers for laterally registering the sheet, and said lateral movement systems intermittently laterally shifting said at least two spaced apart sheet feeding rollers towards said home position thereof without laterally moving a sheet while a sheet is in said intermittent sheet disengaged nips of said at least two sheet feeding rollers to provide increased time for said laterally shifting of said at least two sheet feeding rollers towards said home position.

10. In a sheet lateral registration method for sequentially laterally registering and feeding sheets moving in a sheet path direction with at least two laterally spaced apart sheet feeding and registration rollers forming sheet feeding nips with opposing idlers;

said at least two laterally spaced apart sheet feeding and registration rollers being laterally moveable relative to said sheet path direction towards and away from a lateral home position, said at least two laterally spaced apart sheet feeding and registration rollers having at least first and second different circumferential surface areas respectively having a larger radius and a smaller radius, selectively intermittently partially rotating said at least two sheet feeding and registration rollers to intermittently form a closed sheet feeding nip with said first and larger radius circumferential surface areas with said idlers, selectively intermittently further partially rotating said at least two sheet feeding and registration rollers to intermittently form an open non sheet feeding gap from said idlers with said second and smaller radius of said second circumferential surface areas, intermittently laterally shifting said at least two spaced apart sheet feeding rollers laterally relative to said sheet path direction while a sheet is engaged in said closed sheet feeding nip of said at least two sheet feeding rollers for laterally registering the sheet, and intermittently laterally shifting said at least two spaced apart sheet feeding rollers towards said home position thereof without laterally moving a sheet while a sheet is in said intermittent sheet disengaged nips of said at least two sheet feeding rollers to provide increased time for said laterally shifting of said at least two sheet feeding rollers towards said home position.

11. The sheet lateral registration method of claim 10, wherein said opposing idlers laterally move together with said at least two spaced apart sheet feeding rollers, and said two spaced apart sheet feeding rollers have similar major larger radius cylindrical circumferential lengths and minor smaller radius non-cylindrical circumferential lengths respectively automatically providing with said rotation thereof closed nip sheet feeding and open nip sheet release relative to said opposing idlers.

12. The sheet lateral registration method of claim 10, wherein said larger radius circumferential lengths of said at least two spaced apart sheet feeding rollers are greater than the downstream distance to a subsequent sheet acquisition system.

13. The sheet lateral registration method of claim 10 is integral a high speed printer with an image transfer station in said sheet path, having a sheet acquisition system downstream in said sheet path comprising non-slip sheet feeding nips positioned in said sheet path between said sheet lateral registration method and said image transfer station of said high speed printer.

14. The sheet lateral registration method of claim 10, wherein said at least two spaced apart sheet feeding rollers provide sheet deskewing by differential rotation as well as said lateral sheet registration.

15. The sheet lateral registration method of claim 10, wherein said at least two spaced apart sheet feeding rollers are integral a high speed printer sheet path having closely sequentially spaced print media sheets moving at high speed therein, and said at least two spaced apart sheet feeding rollers provide both lateral registration and deskewing of said closely sequentially spaced print media sheets.

* * * * *